US007324880B2

(12) United States Patent
Lueschow et al.

(10) Patent No.: US 7,324,880 B2
(45) Date of Patent: Jan. 29, 2008

(54) METHOD FOR DETECTING AN ABNORMAL LIFTING CYCLE AND WORK MACHINE USING SAME

(75) Inventors: Kevin J. Lueschow, Elmwood, IL (US); Jeffrey J. Simmons, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 644 days.

(21) Appl. No.: 10/868,462

(22) Filed: Jun. 15, 2004

(65) Prior Publication Data

US 2005/0278101 A1 Dec. 15, 2005

(51) Int. Cl.
*G06F 19/00* (2006.01)

(52) U.S. Cl. ..... 701/50; 37/234; 172/1

(58) Field of Classification Search ..... 701/50; 37/234; 172/1, 260.5; 56/1; 414/699
See application file for complete search history.

(56) References Cited

U.S. PATENT DOCUMENTS 4,466,336 A * 8/1984 Broome et al. ..... 91/420
2005/0278089 A1* 12/2005 Lueschow ..... 701/29

* cited by examiner

*Primary Examiner*—Yonel Beaulieu
(74) *Attorney, Agent, or Firm*—Liell & McNeil

(57) ABSTRACT

An abnormal lifting cycle of a work machine lift component can be indicative of operator error and/or a fault within a lift component coupler. The present disclosure includes a method of detecting a fault for a lift component coupler of a work machine. Pressure within at least one hydraulic cylinder of the coupler is sensed during at least a portion of a lifting cycle of the lift component. A condition of the lifting cycle can be determined by detecting a magnitude of asymmetry within a plurality of the sensed pressures. An abnormal condition of the lifting cycle is indicated if the magnitude of the asymmetry of the plurality of the sensed pressures is outside of a predetermined range of asymmetry.

20 Claims, 3 Drawing Sheets

METHOD FOR DETECTING AN ABNORMAL LIFTING CYCLE AND WORK MACHINE USING SAME

TECHNICAL FIELD

The present disclosure relates generally to work machines with lift components, and more specifically to a method of detecting an abnormal lifting cycle of a work machine lift component.

BACKGROUND

Many types of work machines include lift components, such as loaders, that are attached to work machine bodies via couplers. For instance, a typical loader includes a bucket that is moveably attached to a lift arm, and the loader is coupled to a body of a wheel loader via a coupler. The coupler includes at least one lift hydraulic cylinder that is operable to move the lift arm up and down, and at least one bucket hydraulic cylinder that is operable to move the bucket back and forth about the lift arm. The coupler also includes a plurality of pins, including a pin moveably attaching the lift arm to the machine body, a pin attaching the lift hydraulic cylinder to the machine body and a pin attaching the lift hydraulic cylinder to the arm.

During the operation of the wheel loader, the operator may complete many lifting cycles during which the loader lifts material out of a material pile in order to transport the material to another location. A normal lifting cycle should be smooth and uninterrupted. However, operator error, such as abruptly stopping the upward movement of the loader during the lifting cycle or abruptly varying the speed of the lift, can create an abnormal lifting cycle. In addition to operator error, a faulty coupler can cause abnormal lifting cycles. For instance, the coupler may be insufficiently lubricated, and/or problems may occur in the pins and lift hydraulic cylinder.

Often, problems within the coupler are identified through operator or technician inspection during regularly scheduled maintenance. The delay in detecting problems within the coupler can compound an existing problem and limit the productivity of the loader during operation prior to detection. Further, detection through regularly scheduled maintenance may be subjected to human error, especially if the technicians are not alerted to any performances issues of the loader. In addition, undetected faults for the coupler can lead to breakdown during operation. A breakdown in the loader during operation not only costs time and money, but also can be an annoyance. Thus, a more accurate method of detecting problems within the coupler is needed.

The present disclosure is directed at overcoming one or more of the problems set forth above.

SUMMARY OF THE DISCLOSURE

In one aspect of the present disclosure, a work machine includes a work machine body to which at least one lift component is moveably attached via a coupler. During at least a portion of a lifting cycle, at least one pressure sensor senses a pressure within a hydraulic cylinder of the coupler. The pressure sensor is in communication with an electronic control module and includes a fault detection algorithm that is operable to indicate an abnormal lifting cycle, at least in part, by detecting an asymmetry in a plurality of sensed pressures.

In another aspect of the present disclosure, an article includes a computer readable data storage medium on which a fault detection algorithm is stored. The fault detection algorithm is operable to indicate an abnormal lifting cycle of a lift component moveably attached to a work machine body via at least one hydraulic cylinder. The fault detection algorithm is operable to detect an asymmetry in a plurality of sensed pressures from a hydraulic cylinder.

In yet another aspect of the present disclosure, a fault for a lift component coupler of a work machine is detected by sensing pressure within at least one hydraulic cylinder of the coupler during at least a portion of a lifting cycle of the lift component. A condition of the lifting cycle is determined, at least in part, by detecting a magnitude of asymmetry within a plurality of the sensed pressures. An abnormal condition of the lifting cycle is indicated if the magnitude of the asymmetry of the plurality of sensed pressures is outside a predetermined range of asymmetry.

DETAILED DESCRIPTION

Figure 1:
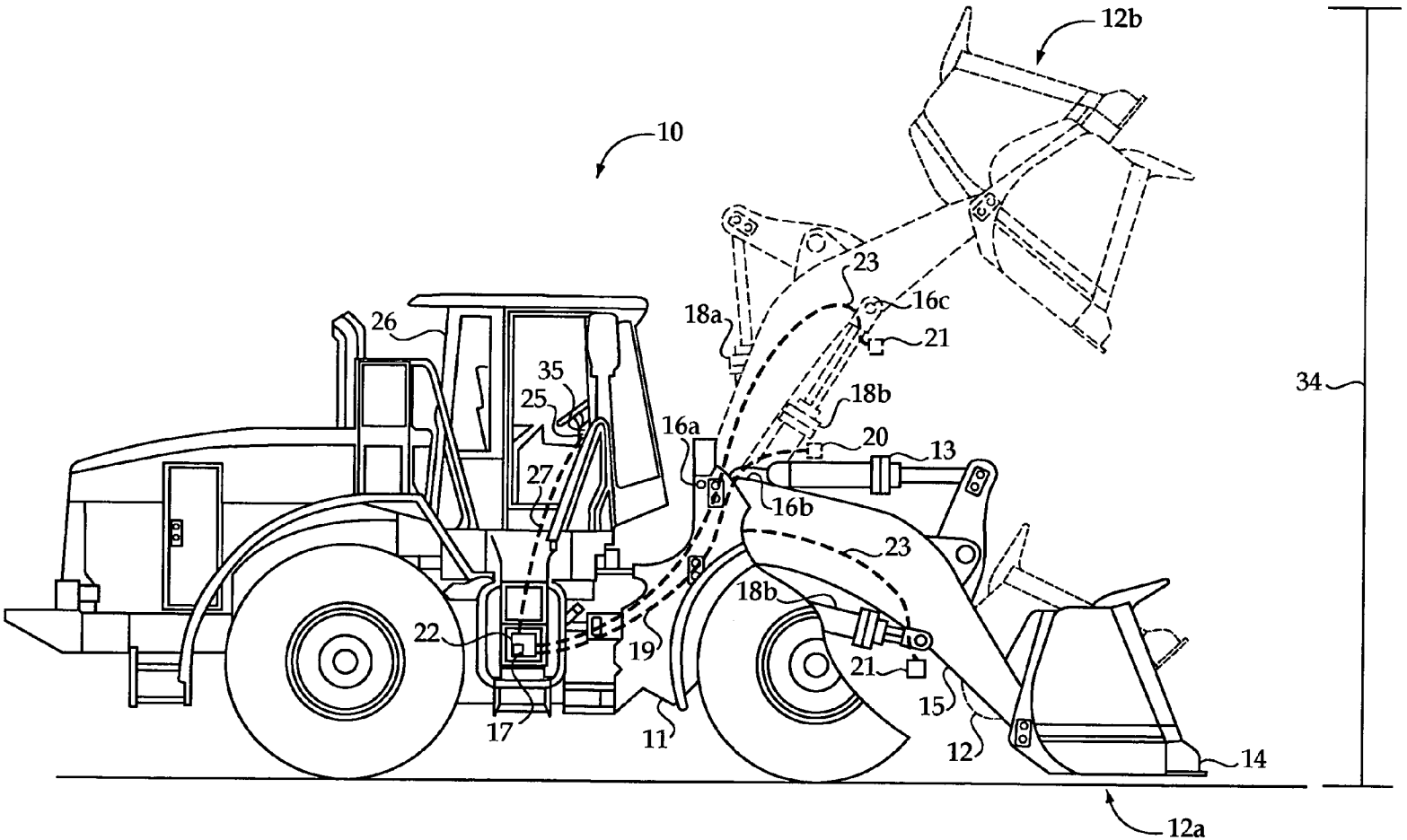
FIG. 1 is a side view of a work machine, according to the present disclosure.

Referring to FIG. 1, there is shown a side view of a work machine 10, according to the present disclosure. Although the work machine 10 is illustrated as a wheel loader, those skilled in the art should appreciate that the present disclosure could apply to any work machine that includes a lift component, including, but not limited to, bull dozer and a backhoe loader. The machine 10 includes a work machine body 11 to which at least one lift component 12, illustrated as a loader, is moveably attached via a coupler 13. The lift component 12 includes a bucket 14 moveably attached to a lift arm 15. In the illustrated machine 10, the coupler 13 includes two hydraulic cylinders 18*a* and 18*b* that are positioned between the work machine body 11 and the lift component 12. A bucket hydraulic cylinder 18*a* is operable to move the bucket 14 about the lift arm 15, and a lift hydraulic cylinder 18*b* is operable to move the lift arm 15 up and down. The coupler 13 also includes a plurality of pins 16 (not all are shown) that attach the lift component 12 to the work machine body 11 and the hydraulic cylinders 18*a* and 18*b* to the lift component 12 and the work machine body 11. The plurality of pins 16 includes a first pin 16*a* that moveably attaches the lift arm 15 to the work machine body 11, a second pin 16*b* that attaches the lift hydraulic cylinder 18*b* to the work machine body 11, and a third pin 16*c* that attaches the lift hydraulic cylinder 18*b* to the lift arm 15. It should be appreciated that the illustrated coupler 13 includes additional pins attaching the hydraulic cylinder 18*a* to the work machine body 11 and coupling the hydraulic cylinder 16*a* to move the bucket 14.

The lift component 12 of FIG. 1 is illustrated as in a first position 12*a* and a second position 12*b* (shadowed). When the lift component 12 is in the first position 12*a*, the bucket 14 is in on or near the ground, and when the lift component 12 is in the second position 12*b*, the bucket 14 is elevated. A lifting cycle includes the movement of the lift component 12 from the first position 12*a* towards the second position 12*b*. A complete lifting cycle 34 of the lift component 12 includes the movement of the lift component 12 from the first to the second position 12*a* and 12*b*. Thus, it should be appreciated that during a lift, the lift component 12 may not go through the complete lifting cycle 34. Those skilled in the art will appreciate that the pressure within the lift hydraulic cylinder 18*b* required to lift the arm 15 increases as the lift component 12 is raised during the lifting cycle. Further, those skilled in the art will appreciate that the greater a payload weight, being the weight of material in the bucket 14, the greater pressure required to raise lift component 12. Thus, a normal lifting cycle produces a steady increase in pressure. Whereas, an abnormal lifting cycle may include asymmetrical pressure spikes and dips.

The machine 10 includes at least one pressure sensor 20 that is operable to sense a pressure within the lift hydraulic cylinder 18*b* during at least a portion of the lifting cycle of the lift component 12. The machine 10 also includes at least one position sensor 21 of a type known in the art that is operable to sense the position of the lift component 12. In the illustrated example, the position sensor 21 senses the extension of the lift hydraulic cylinder 18*b* in order to determine the position of the lift component 12 within the complete lifting cycle 34. Both the pressure sensor 20 and the position sensor 21 are in communication with an electronic control module 22 via a pressure communication line 19 and a position communication line 23, respectively.

The electronic control module 22 includes an article 17 that includes a computer readable data storage medium on which a fault detection algorithm 24 is stored. However, it should be appreciated that the fault detection algorithm 24 could be included on any article that includes a storage medium, regardless of whether the article is included on the electronic control module within the work machine. The fault detecting algorithm 24 is operable to indicate an abnormal lifting cycle, at least in part, by detecting an asymmetry in a plurality of the sensed pressures. A fault indicator 22 is in electrical communication with the electronic control module 22 via an indicator line 27. The fault indicator 22 preferably includes a prompter 35 that is operable to prompt the operator to complete a second, uninterrupted and smooth lift. The fault indicator 25 is attached to the work machine body 11, preferably within an operator control station 26 such that the operator can observe and/or hear when the fault indicator 25 activates. Thus, the fault indicator 25 and prompter 35 can be a visual indicator, such as a light, or an audio indicator.

Figure 2:
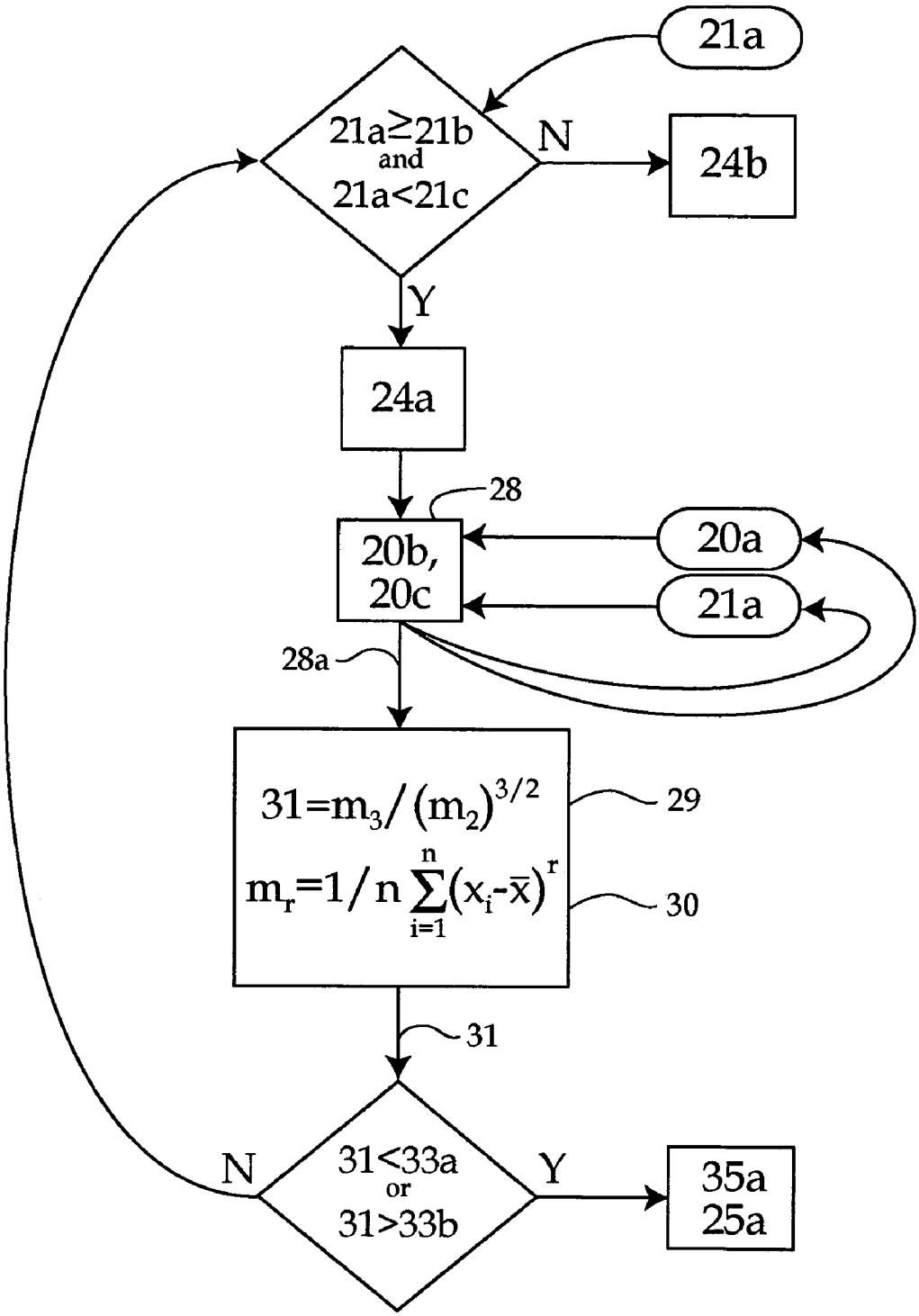
FIG. 2 is a flow chart of a fault detection algorithm, according to the present disclosure.

Referring to FIG. 2, there is shown a flow chart of a fault detection algorithm 24, according to the present disclosure. The fault detection algorithm 24 is operable to indicate an abnormal lifting cycle, at least in part, by detecting an asymmetry in a plurality of the sensed pressures. It should be appreciated that an abnormal lifting cycle could be caused by operator error or a faulty coupler. The fault detection algorithm 24 is preferably operable when the position sensor 21 senses that the position 21*a* of the lift component 12 is between an activation position 21*b*, being approximately 45-50% of the complete lifting cycle 34, and a de-activation position 21*c*, being approximately 75-80% of the complete lifting cycle 34. The activation position 21*b* is based on an observation that, during most lifts, at about 45-50% through the complete lifting cycle 34, the payload weight in the bucket 14 is stabilized, meaning that the bucket 14 has been raised out of a pile of material from which it has shoveling. The de-activation lift component position 21*c* is based on the observation that, during most lifts, the lift component 12 will be raised to at least 75-80% of the lifting cycle 34.

The pressure sensor 20 and the position sensor 21 communicate the sensed pressure 20*a* and the sensed position 21*a* to the fault detection algorithm 24. The fault detection algorithm 24 includes a conversion algorithm 28 that is operable to estimate a payload weight 28*a* based, at least in part, on the sensed pressure 20*a*. The conversion algorithm 28 includes a set of known pressures 20*b* within the hydraulic cylinder 18*b* for an empty lift component at known lift component positions, and a set of known pressures 20*c* within the hydraulic cylinder 18*b* for a full lift component at the known lift component positions. Those skilled in the art will appreciate that by comparing the sensed pressure 20*a* within the hydraulic cylinder 18*b* with the known pressures 20*b* and 20*c* for the empty lift component and for the full lift component at the sensed position 21*a*, the conversion algorithm 28 can estimate the payload weight 28*a* within the bucket 14. Those skilled in the art will appreciate that many work machines already include a payload weight system in which the payload is estimated based on the sensed pressure within the hydraulic cylinder 18*b*.

The fault detection algorithm 24 includes a weight asymmetry algorithm 29 that is operable to detect an asymmetry in a plurality of estimated payload weights 28*a*. The weight asymmetry algorithm 29 preferably includes a skew determining algorithm 30. Thus, although the present disclosure contemplates other methods of detecting an asymmetry in the plurality of estimated payload weights, preferably the asymmetry is detected by determining the skew of the plurality of the estimated payload weights 28*a*. Those skilled in the art will appreciate that skew is the third moment about the mean of a sample. In other words, skew is a measure of the asymmetry of a distribution of the estimated payload weights 28*a*. Although the number of estimated payload weights used to determine skew may vary, in the illustrated example, the plurality of estimated payload weights 28*a* includes approximately eighty estimated weights 28*a*. Thus, the weight asymmetry algorithm 29 is operable to determine skew of the eighty estimated weights 28*a*, which were all recorded during a single lifting cycle. After skew for the estimated weights 28*a* has been calculated, the estimated weights can be discarded and/or written over with newly estimated weights by the weight asymmetry algorithm 29. Because the pressure within the hydraulic cylinder 18*b* is being sensed frequently, such as maybe every 1/25 millisecond, skew is being determined rather quickly. The present disclosure also contemplates that skew can be determined without storing estimated payload weight, but rather calculated and updated with each estimated payload weight. Although updating skew based on each estimated payload weight may be preferred for accuracy, it may require more real time processing power.

The skew determining algorithm 30 preferably includes a coefficient of skewness 31. Thus, although skew can be determined by other methods, the skew of the plurality of estimated payload weights 28*a* is preferably determined by calculating a coefficient of skewness 31 for the plurality 28*a*. Those skilled in the art will appreciate that the coefficient of skewness 31 is $m_3/(m_2)^{3/2}$, where $m_2$ and $m_3$ are the second and third moments about the mean of sample, respectively. The second and third moments about the mean can be determined by the following formula: $m_r=1/n\ \Sigma(x_i-x)^r$, where r is 2 for the second moment and 3 for the third moment, n is the number of data in the sample, and x is the mean. The present disclosure also contemplates other formulas used to calculate skew, such as Pearson's second coefficient of skewness. The formula to calculate Person's second coefficient of skewness is as follows: $3(x-M_d)/s$, where x is the mean, $M_d$ is the median, and s is standard deviation. Although Pearson's second coefficient of skewness is a quicker method of determining skew, it is sometimes less accurate than calculating the coefficient of skewness 31.

The fault detection algorithm 24 includes a fault indicating algorithm 32 being operable to indicate when the calculated skew, preferably being the coefficient of skewness 31, is outside a predetermined range of skew 33. It should be appreciated that the coefficient of skewness 31 ranges from −2 to 2, with zero being no skew (i.e., symmetrical data). The predetermined range of skew 33 is the range of skew that is expected and tolerable within the estimated weights 28*a*. Those skilled in the art will appreciate that the estimated weights 28*a* over the normal lifting cycle will generally be slightly skewed. However, the estimated weights 28*a* over an abnormal lifting cycle will exhibit relatively significant skew. In the illustrated example, a negative end 33*a* of the predetermined range of skew 33 is preferably −0.5 and a positive end 33*b* is 0.5. This predetermined range of skew 33 is relatively intolerant of abnormal lifting cycles. However, the present disclosure contemplates the predetermined range of skew 33 being adjusted in order to be more tolerant of abnormal lifting cycles. For instance, the predetermined range of skew could be −1.0 to 1.0, or even −1.5 to 1.5. A predetermined range of skew of −1.5 to 1.5 may be only detecting abnormal lifting cycles based on relatively severe operator error or faults within the coupler.

The fault detection algorithm 24 is deactivated 42*b* if the position sensor 21 senses that the lift component position 21 is equal to or greater than de-activation lift component position 21*c*, being 75-80% of the complete lifting cycle 34. The de-activation lift component position 21*c* is based on the observation that, during most lifts, the lift component 12 will be raised to at least 75-80% of the lifting cycle 34. Thus, the data used to detect an abnormal lifting cycle preferably is gathered and stored during a middle portion of the complete lifting cycle 34.

Figure 3A:
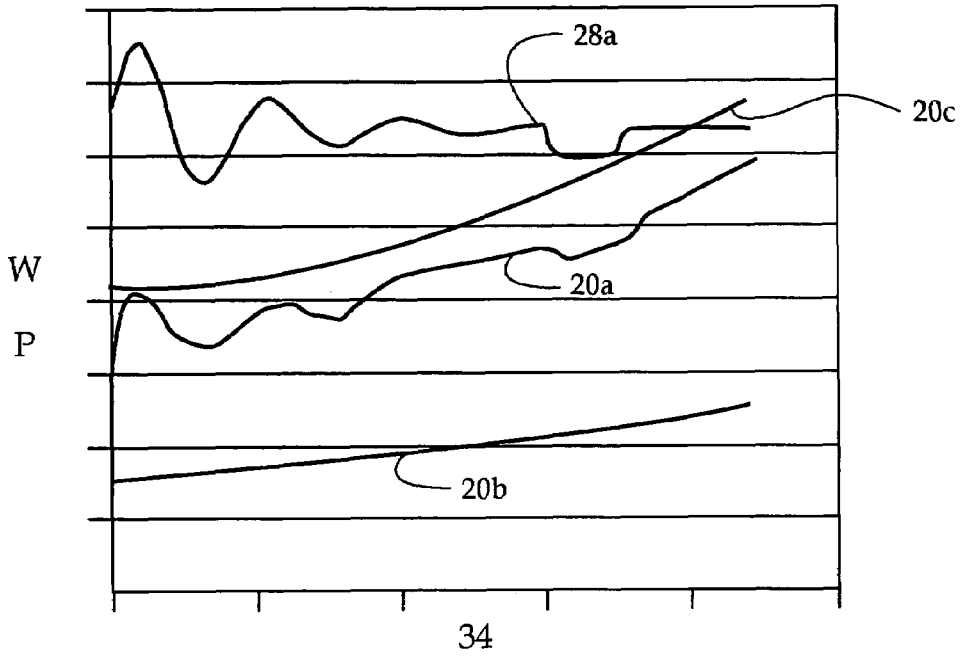
FIG. 3*a* is a graph illustrating sensed pressure within a hydraulic cylinder and estimated payload weight for an abnormal lifting cycle of the work machine of FIG. 1.
Figure 3B:
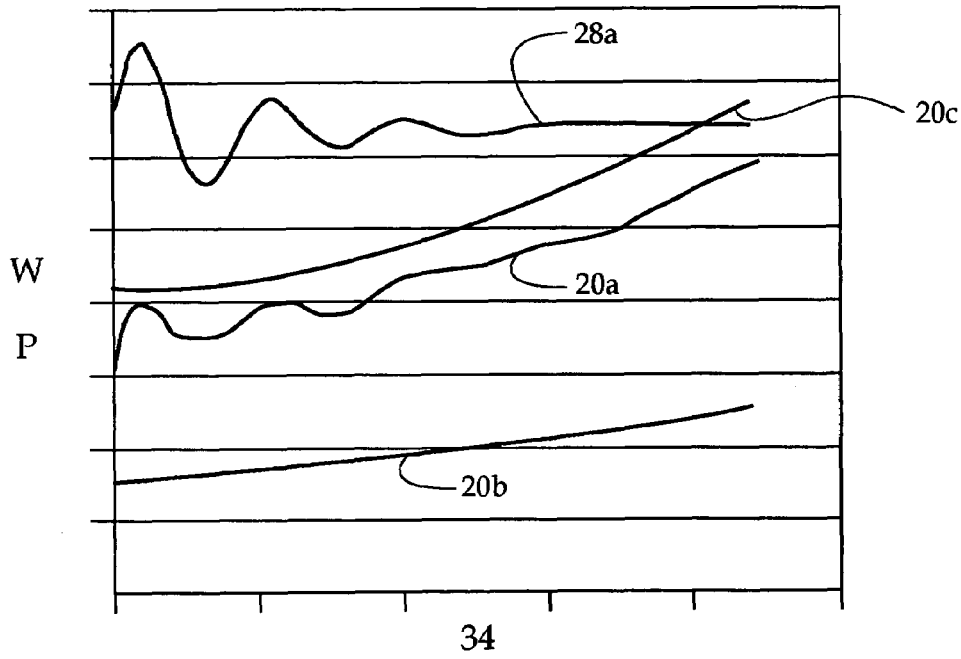
FIG. 3*b* is a graph illustrating sensed pressure within the hydraulic cylinder and estimated payload weight for a normal lifting cycle of the work machine of FIG. 1.

Referring to FIGS. 3*a* and 3*b*, there are shown graphs illustrating the sensed pressure within the lift hydraulic cylinder 18*b* and estimated payload weight for an abnormal lifting cycle and a normal lifting cycle of the work machine of FIG. 1, respectively. In both FIGS. 3*a* and 3*b*, along the x-axis, the position of the lift component 12 within the lifting cycle 34 is illustrated, and along the y-axis, the pressure (P) within the hydraulic cylinder 18*b* and the estimated payload weight (W) is illustrated. In both FIGS. 3*a* and 3*b*, the known pressures 20*b* and 20*c* for a full and empty lift component, respectively, over the lifting cycle 34 are shown. These pressure values 20*b* and 20*c* are known and stored within the fault detection algorithm 24 in order to estimate the payload weight 28*a* from the sensed pressure 20*a*.

In both the normal and abnormal lifts, as the lift component 12 is lifted, the sensed pressure 20*a* within the hydraulic cylinder 18*b* increases. Although the sensed pressure 20*a* may fluctuate near the beginning of the lifting cycle 34, the estimated payload weight 28*a* based on the sensed pressure 20*a* fluctuates about a mean, and thus, has minimal skew. However, unlike the sensed pressure 20*a* in the normal lift of FIG. 3*b*, the sensed pressure 20*a* of the abnormal lift of FIG. 3*a* dips near the end of the lifting cycle 34. The dip in the pressure 20*a* correlates to a dip in the estimated weight 28*a*. Because there is no corresponding increase about the mean in the estimated weight 28*a* for the abnormal lift, the estimated weight 28*a* is skewed. Thus, the fault detection algorithm 24 would indicate an abnormal lift in FIG. 3*a*, but not in FIG. 3*b*. Those skilled in the art should appreciate that an abnormal lifting cycle can include estimated weights 28*a* that are skewed due to an abrupt increase, rather than decrease, in the pressure 20*a*.

Referring to FIGS. 1-3*b*, a method of detecting a fault for the lift component coupler 13 of the machine 10 will be discussed. Although the present disclosure will be discussed for a wheel loader 10, it should be appreciated that the present disclosure can find application in any work machine with a lift component. During the operation of the machine 10, the operator will shovel the material, being the payload, with the bucket 14 of the lift component 12, and lift the payload with the lift arm 15 in order to move the payload to another location. It has been found that if the operator correctly performs an uninterrupted and smooth lift, there should be a normal lifting cycle as illustrated in FIG. 3*b*. However, the operator may commit an error, including but not limited to, abruptly varying the speed of the upward movement of the lift component or interrupting the lifting cycle by abruptly stopping the upward movement of the lift component 12. If so, the lifting cycle will be abnormal. Further, if the machine 10 includes a faulty coupler 13, the lifting cycle will be abnormal as illustrated in FIG. 3*a*.

In order to detect an abnormal lifting cycle regardless of whether the abnormal lifting cycle is caused by operator error or a faulty coupler, the pressure sensor 10 will sense the pressure within the lift cylinder 18*b* during a portion of the complete lifting cycle 34. Thus, the fault detection algorithm 24 will operate for the portion of the complete lifting cycle 34 during which lifts normally pass. The fault detection algorithm 24 is preferably activated 24*a* when the position sensor 21 senses that the lift component position 21*a* is equal to the activation lift component position 21*b*, which is 45-50% of the complete lifting cycle 34. By 45-50% of the complete lifting cycle 34, the payload should be stabilized in the bucket 14, meaning that bucket 14 should be out of the pile of material from which the bucket 14 is shoveling.

After the fault detection algorithm 24 is activated 24*a*, the fault detection algorithm 24 will determine a condition of the lifting cycle, at least in part, by detecting a magnitude of asymmetry within a plurality of the sensed pressures 20*a*. The position sensor 21 will continue to sense the position of the lift component 12 and communicate the sensed position 21*a* to the weight conversion algorithm 28 of the fault detection algorithm 24. The pressure sensor 20 will sense the pressure within the hydraulic cylinder 18*b* and communicate the sensed pressure 20*a* to the weight conversion algorithm 28. The data is preferably stored for processing at the end of the lifting cycle, but may be processed in real time using known statistical techniques.

Based on the sensed pressure 20*a* and the sensed position 21*a*, the weight conversion algorithm 28 will estimate the payload weight 28*a* within the bucket 14 of the lift component 12. In order to estimate the payload weight 28*a* at the sensed position 21*a*, the weight conversion algorithm 28 compares the sensed pressure 20*a* to the known pressure 20*b* and 20*c* of the empty lift component 12 and of the full lift component 12, respectively, at the sensed position. The estimated weight 28*a* is communicated to the weight asymmetry algorithm 29 of the fault detection algorithm 24. In the illustrated example, the estimated weights 28*a* are stored by the weight asymmetry algorithm 29 until there is the predetermined plurality of data points, preferably at least eight data points, but, at least, a minimum of sixty. However, it should be appreciated that the asymmetry of the estimated weights 28*a* can be calculated and updated without storing the estimated weights, but to do so, requires relatively more intense processing. In order to determine the asymmetry within the plurality of the sensed pressures 20*a*, the weight asymmetry algorithm 29 will calculate skew of the plurality of the estimated payload weights 28*a*. Because the pressure is being sensed within the hydraulic cylinder 18*b* frequently, such as every 1/25 millisecond, one will appreciate that skew is being calculated relatively quickly.

In order to calculate the skew of the plurality of estimated weights 28*a*, the coefficient of skewness 31 is preferably calculated. The present disclosure also contemplates determining skew by calculated Pearson's second coefficient of skewness, which is a quicker, but less accurate method of calculating skew. Also, those skilled in the art will recognize that any technique for detecting an asymmetry in the data would be compatible with the present disclosure. In order to calculate the coefficient of skewness 31 for the plurality of estimated weights 28*a*, the following formula is used: $m_3/(m_2)^{3/2}$, where $m_2$ and $m_3$ are the second and third moments about the mean of sample, respectively. The second and third moments about the mean can be determined by the following formula: $m_r=1/n\ \Sigma\ (x_i-x)^r$, where r is 2 for the second moment and 3 for the third moment, n is the number of data in the sample, and x is the mean. Those skilled in the art will appreciate that the coefficient of skewness 31 can range from −2 to 2 with zero being no skew. After the coefficient of skewness 31 of the plurality of estimated weights 28*a* is calculated, the estimated weights 28*a* upon which skew was calculated can be discarded and/or written over by newly estimated weights 28*a* until another plurality is stored. The coefficient of skewness 31 will then be estimated for the next plurality of estimated weights.

After the asymmetry within the sensed pressures 20*a* is determined by calculating the coefficient of skewness 31 for the plurality of estimated weights 28*a*, an abnormal condition of the lifting cycle is indicated if the magnitude of the asymmetry is outside of the predetermined range of asymmetry. The magnitude of asymmetry is communicated to the fault indicating algorithm 32 as the coefficient of skew 31 for the estimated weights 28*a*. The fault indicating algorithm 32 is operable to indicate an abnormal lifting cycle if the coefficient of skewness 31 of the plurality of estimated weights 28*a* is outside of the predetermined range of skew 33, illustrated as −0.5 to 0.5.

If the coefficient of skewness 31 is within the predetermined range of skew 33, the fault detection algorithm 24 will determine whether to de-activate 24*b* the fault determination algorithm 24. If the sensed position of the lift component 12 is less than the de-activation loader position 21*c*, being 75-80% of the complete lifting cycle 34, the fault determination algorithm 24 will continue to monitor the magnitude of the asymmetry of the sensed pressure 20*a*. If the lift component position 21*a* is greater than 75-80% of the complete lifting cycle 34, the fault detection algorithm 24 will preferably be de-activated 24*b*. In other words, data for processing is preferably gathered for only a middle portion of the lifting cycle. This should reduce the occurrence of false positive indications of abnormal lifting.

If the coefficient of skewness 31 is outside of the predetermined range of skew 33, the fault indicating algorithm 32 will indicate that there is an abnormal lifting cycle. This information may also be stored for later analysis. The electronic control module will activate the fault indicator 25 and prompter 35 via the indicator communication line 27. The activated fault indicator 25*a* will indicate to the operator that there was an abnormal lift. In order to determine whether the abnormal lifting cycle was caused by operator error, the activated prompter 35*a* will prompt the operator to perform a second, uninterrupted and smooth lift. During the second lift, the fault detection algorithm 24 will again be operable to indicate whether there was an abnormal lifting cycle. If the second, smooth and uninterrupted lift is abnormal, the indicator 25 will indicate a fault for the coupler 13. Because the second lifting cycle was smooth and uninterrupted, but still indicated as abnormal, the abnormal cycle is likely caused by the faulty coupler 13. If the fault detection algorithm 24 does not indicate an abnormal lifting cycle on the second lift, the first abnormal cycle was likely caused by operator error. The operator may have interrupted the lift with an abrupt stop during the lift or varied the speed of the lift, thereby causing an abnormal first lifting cycle. Thus, the fault detection algorithm 24 will not alert the operator that maintenance and/or inspection is needed on the coupler 13.

The present disclosure is advantageous because it provides an accurate method of detecting a faulty coupler or operator error during operation of the work machine 10 by using existing sensors and software outputs. It is common for a work machine with a lift component to include a payload control system that estimates and monitors the payload weight being lifted by the work machine. The payload weight is estimated from the pressure within the hydraulic cylinder. By knowing the payload weight, the productivity of the operator can be monitored. However, the present disclosure uses for the estimated payload weights 28*a* for an additional purpose, i.e., to detect a faulty coupler and/or repeated operator errors in performing proper lifts. By determining the magnitude of asymmetry within the estimated payload weights 28*a* during a lift, the present disclosure can detect an abnormal lift. Then, by prompting the operator to perform a second uninterrupted and smooth lift, the present disclosure can be used to determine whether the abnormal lift is due to a faulty coupler or operator error. Errors, such as abruptly increasing the speed of a lift, can cause an abnormal lift. The present disclosure can identify a work machine with an operator that consistently performs abnormal lifting cycles so the operator can be trained, or re-trained, on performing normal lifting cycles.

The present disclosure is further advantageous because it detects faults for the coupler 13 when they begin to adversely affect the lift cycle of the lift component 12. This allows problems to be detected, and remedied, early, before work machine performance is undermined and/or components are damaged. Thus, the work machine 10 will not be operated with a faulty coupler caused by problems, such as insufficient lubrication, leaky hydraulic cylinder 18*b* and wear of the pins 16. Money and time will be saved by detecting and repairing these faults early.

It should be understood that the above description is intended for illustrative purposes only, and is not intended to limit the scope of the present disclosure in any way. Thus, those skilled in the art will appreciate that other aspects, objects, and advantages of the disclosure can be obtained from a study of the drawings, the disclosure and the appended claims.

What is claimed is:

1. A work machine comprising:

a work machine body;

at least one lift component moveably attached to the work machine body via a coupler that includes at least one hydraulic cylinder;

at least one pressure sensor operable to sense a pressure within the hydraulic cylinder during at least a portion of a lifting cycle; and an electronic control module being in communication with the pressure sensor and including a fault detection algorithm being operable to indicate an abnormal lifting cycle, at least in part, by detecting an asymmetry in a plurality of sensed pressures.

2. The work machine of claim 1 wherein the lift component including a loader; and the coupler including a plurality of pins.

3. The work machine of claim 1 wherein the fault detection algorithm includes a fault indicating algorithm being operable to indicate an abnormal lifting cycle.

4. The work machine of claim 3 wherein the fault detection algorithm being in electrical communication with a fault indicator attached to the work machine body.

5. The work machine of claim 1 wherein the fault detection algorithm includes a conversion algorithm being operable to estimate a payload weight based, at least in part, on the sensed pressure.

6. The work machine of claim 5 wherein the fault detection algorithm includes a weight asymmetry algorithm being operable to detect the an asymmetry in a plurality of estimated payload weights.

7. The work machine of claim 6 wherein the weight asymmetry algorithm includes a skew determining algorithm.

8. The work machine of claim 7 wherein the skew determining algorithm includes a coefficient of skewness.

9. The work machine of 8 wherein the work machine being a wheel loader;

the lift component includes a bucket moveably attached to at least one arm, and the coupler includes a plurality of pins; and the fault detection algorithm includes a fault indicating algorithm being operable to indicate an abnormal lift and being in electrical communication with an operator prompter.

10. An article comprising:

a computer readable data storage medium; and a fault detection algorithm being stored on the data storage medium and being operable to indicate an abnormal lifting cycle of a lift component moveably attached to a work machine body via a at least one hydraulic cylinder, at least in part, by detecting an asymmetry in a plurality of sensed pressures from a hydraulic cylinder.

11. The article of claim 10 wherein the fault detection algorithm includes a conversion algorithm being operable to estimate a payload weight based, at least in part, on the sensed pressure.

12. The article of claim 11 wherein the fault detection algorithm includes a weight asymmetry algorithm being operable to detect the an asymmetry in a plurality of estimated payload weights.

13. The work machine of claim 12 wherein the weight asymmetry algorithm includes a skew determining algorithm.

14. The work machine of claim 13 wherein the skew determining algorithm includes a coefficient of skewness.

15. The article of claim 14 wherein the fault detection algorithm includes a fault indicating algorithm being operable to indicate an abnormal lifting cycle.

16. A method of detecting a fault for a lift component coupler of a work machine, comprising the steps of:

sensing pressure within at least one hydraulic cylinder of the coupler during at least a portion of a lifting cycle of the lift component;

determining a condition of the lifting cycle, at least in part, by detecting a magnitude of asymmetry within a plurality of the sensed pressures; and indicating an abnormal condition of the lifting cycle if the magnitude of the asymmetry of the plurality of sensed pressures is outside a predetermined range of asymmetry.

17. The method of claim 16 wherein the step of determining the condition of the lifting cycle includes a step of estimating a payload weight based on the sensed pressure.

18. The method of claim 17 wherein the step of determining the condition of the lifting cycle includes a step of calculating skew of a plurality of the estimated payload weights.

19. The method of claim 18 wherein the step of determining the condition of the lifting cycle includes a step of calculating a coefficient of skewness.

20. The method of claim 16 wherein the step of indicating includes a step of prompting at least a second lifting cycle.

* * * * *